US006006923A

United States Patent [19]

Helmy et al.

[11] Patent Number: 6,006,923

[45] Date of Patent: Dec. 28, 1999

[54] SCREENING APPARATUS

[75] Inventors: Nashat N. Helmy, Golden Valley; Lonn M. Young, Columbia Heights, both of Minn.

[73] Assignee: Tandem Products, Inc., Minneapolis, Minn.

[21] Appl. No.: 08/877,120

[22] Filed: Jun. 17, 1997

[51] Int. Cl.[6] ..... B07B 1/49

[52] U.S. Cl. ..... 209/397; 209/399; 209/405; 209/412

[58] Field of Search ..... 209/397, 399, 209/398, 404, 405, 408, 412

[56] References Cited

U.S. PATENT DOCUMENTS 5,104,521 4/1992 Rutherford ..... 209/399
5,248,043 9/1993 Dorn ..... 209/399

FOREIGN PATENT DOCUMENTS 1483217 8/1977 United Kingdom ..... 209/397

*Primary Examiner*—David H. Bollinger

*Attorney, Agent, or Firm*—Nawrocki, Rooney & Sivertson, P.A.

[57] ABSTRACT

This improved screening apparatus for sorting various size aggregates utilizes a screen made of polyurethane having two sets of perpendicular evenly spaced parallel webs each of which enclose a wire provided for reinforcement. If desired, the reinforcing wires can be single or multiple through either one or through both sets of webs. Web segments extend between web intersections. Areas enclosed by opposed adjacent web segments provide for the screen openings. This area can contain either a single hole or a plurality of holes to provide a number of different screen sizes. The holes increase in cross-section from the screen aggregate input side to the output side to eliminate or greatly minimize particles wedging within the holes. Backing bucker bars of various widths attached to the lower side of the screen provide a predetermined screen cross-section when their lower edges are supported horizontally. Hooks attached to opposite sides of the screen by bolts, arranged to engage mating mounting brackets, permit applying varying tension to the screen by tightening nuts which secure the bolts.

9 Claims, 2 Drawing Sheets

SCREENING APPARATUS

BACKGROUND OF THE INVENTION

1. Field of the Invention

This invention relates to improved screening apparatus, in particular to sieves which combine a screen with a support.

2. Description of the Prior Art

Screens are used to separate and size different rocks, stones, gravel, water slurries and similar aggregate mixtures. Two characteristics are of major important in screens. One is the open area of the screen versus the total screen area, the larger the open area versus the total area the more efficient the screening process. The second is the wear life of the screen since a short life requires frequent screen changes which incurs both the screen and screen replacement costs. Both of these characteristics are economically important in the screening process.

Screens were originally formed only from woven wire. These screens were made of steel, stainless steel or spring steel wire. While wire screens have the largest open area versus the total screen area of about 50 to 55% of any screen, they also have the highest wear rate. To counter this high wear rate about 15 years ago screens were introduced made of polyurethane which greatly reduced the screen wear rate. While polyurethane screens greatly reduce the screen wear rate, they are considerably thicker than wire which reduces the amount of open area versus the total screen area to only 40 to 45 percent of the total area. This proportionally reduces the screen efficiency. Further, because of the lesser strength of polyurethane, cable rope under tension were incorporated into the screens to provide additional screen strength. This further reduces the open area and efficiency of the screens. Cables created another problem in that the cable had to remain under considerable tension to provide proper screen support. In manufacture, cables under tension are placed in an upwardly open mold which provided the frame shape, and mixed polyurethane plastic is poured around the cables until the frame is filled. The plastic is allowed to cure and the screens are then removed from the molds. After removal quite often the plastic will not hold the cables under the desired tension because of the inherent low friction between the plastic and cables.

Whenever polyurethane screens are substituted for wire screens, the structure which supported the wire screens must also be retrofitted to support polyurethane screens. The trade-offs between the relative advantages and disadvantages between wire and polyurethane screens have resulted in the industry currently using about 20% polyurethane screens and 80% wire screens.

It would be desirable if the wear characteristics of polyurethane could be obtained without the disadvantage of the reduction in open area versus open screen area, without the necessity for the use of cables to provide additional strength, and without having to retrofit the screen apparatus.

SUMMARY OF THE INVENTION

The screen apparatus improvement of the present invention uses a polyurethane screen formed of a plurality of two sets of reinforcing webs at right-angles to each other, each web enclosing a wire where the wires in both sets of webs can be interleaved. If desired, interleaved wires can be welded at intersections for further rigidity. By reinforcing the screen itself with wire, the amount of material covering each wire, i.e. the web cross-section, can be reduced well below that of previous unreinforced frames. This arrangement combines the low wear characteristics of a plastic frame with the strength of a wire sieve. This approach not only reduces the amount of material interposed by the polyurethane screen, but also eliminates the requirement for additional supporting cables since the enclosed wires themselves can be made strong enough to provide any additional strength which may be required to supplement the strength of the polyurethane itself.

There is no problem of slippage of the wires relative to the plastic, as occurs in cables, because the wires do not have to be placed in tension. However, even if tension were ever a requirement, the small wire size used here provides much greater friction between the wires and the plastic. This approach eliminates the previous cable slippage problem while still retaining the necessary supporting strength.

Screens requiring large sieve openings use the rectangular space between the webs for the sieve openings. Here, the wire spacing and wire strength can be tailored for different size large screens. In contrast, for smaller sieve openings than those possible using the rectangular openings between the webs, the space between the webs is interconnected by a planar sheet containing the sieve holes. This sheet can be arranged to have holes of virtually any size and any desired pattern. These two approaches together provide a simple and effective means of tailoring the screen for any desired large or small sieve openings.

Both of these approaches increase the relative percent of the sieve openings versus the previous polyurethane screen approach, do not require any supplementary cables for additional strength, and retain the desired wearability characteristics of plastic.

This improved screen also permits substituting a standard wire frame for either urethane modular screens or urethane tension screens with no conversion being required. This saves the costly conversion of screens from frames which fit the previous urethane screens. These screens not only provide the long wear life of polyurethane but also provide an improvement in screen efficiency, because the smaller frame cross-sections result in a greater open screen.

A problem not addressed by previous polyurethane screens is that some particles can enter the screen holes but can still become lodged within the holes. When this occurs the blocked opening is removed from the screening operation with a corresponding reduction in screen efficiency. This problem is overcome in the present invention by having the holes through the screen expand in size from the screen aggregate entry side to the exit side. Virtually any particle which can enter the upper hole can move through this expanding hole without blocking it.

Another problem is the desirability of reducing the web thickness to reduce the screen weight and the amount of plastic used. This problem cannot be addressed by screens made only of polyurethane because the webs must be made thick enough to withstand the weight of the aggregate upon the screens. In the present invention, since the wires provide additional strength, the web thickness can be reduced.

The cross-sectional area of the wires determines the supporting strength. In cases where the cross-section required by a single supporting wire is excessive such that the web thickness will result in excessive screen weight, the wire area can be divided between wires placed side by side within the webs. This permits reducing the web thickness while still retaining the same wire strength. Usually only wires extending through the screen in one direction need be doubled, if desired however the number of wires extending in both directions through the screen sets could also be doubled. Also, wires greater in number than two could be used with the necessary tensile strength also being divided between them.

BRIEF DESCRIPTION OF THE DRAWINGS

Objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE INVENTION

Figure 1:
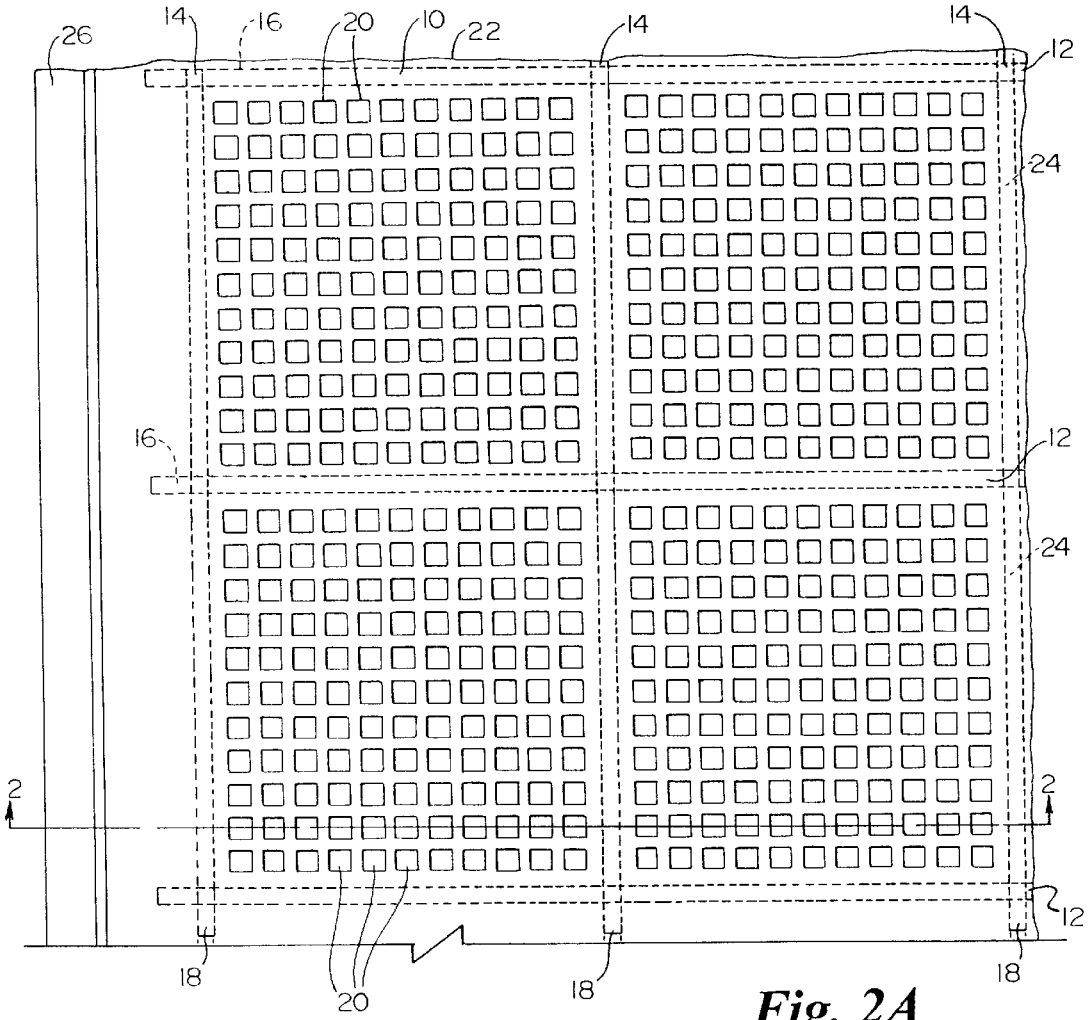
FIG. 1 is a plan view of a portion of a screen and attachment apparatus.
Figure 2A:
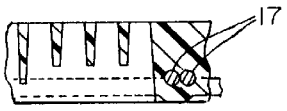
FIG. 2A is a detail of a pair of wires in cross-section.
Figure 2:
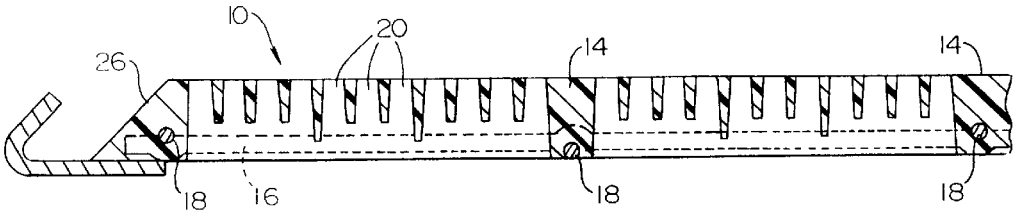
FIG. 2 is a cross-section view of FIG. 1.

FIGS. 1 and 2 show essentially planar screen 10 made of polyurethane with a generally rectangular shape. Screen 10 has parallel spaced apart webs 12 extending from edge to edge and perpendicular and parallel spaced apart webs 14 extending from edge to edge across the perpendicular edges formed into the screen.

Webs 12 encapsulate a first set of wires 16 and webs 14 encapsulate a second set of wires 18. As shown here wires 16 and 18 are interwoven, however, since webs 16 and 14 secure the wires in place, this is not a necessity for proper screen operation.

Holes 20 extend through screen 10 between webs 12 and 14 and expand in size from the top to the bottom. This is a critical feature since in present screens particles, which can enter the top of the screen holes, can occasionally become wedged within the hole. In the present invention, since holes 20 expand outwardly towards the exit side this possibility is greatly minimized if not completely eliminated.

Webs 12 have segments 22 extending between webs 14 and webs 14 have segments 24 extending between webs 12. As shown here, there are 121 holes in any single enclosed area between opposing web segments 22 and adjacent opposing web segments 24. However essentially any other number of holes and any number of hole patterns can be provided in any enclosed area including a single hole extending completely to the enclosing webs. Changing the number and size of the holes 20 in the enclosed area between adjacent surrounding wires 16 and 18 provides a tremendous range of hole sizes for screening. In addition to changing the number of holes, the spacing between wires 16 and 18 can be changed when only a single hole 20 is provided to provide an additional range of large hole sizes.

In some instances to provide sufficient strength wires may have to be increased to such a large cross-sectional area that the depth of polyurethane screen 10 would be increased to an unacceptable weight. This is avoided by using pair of wires 17 instead of a single wire as shown in FIG. 2A which reduces the overall screen depth. This is possible because the total cross-section area of the wires determines the total tensile strength. Dividing the cross-section area between two wires will effectively produce a smaller grid cross-section. As an example, if the required area for the wire is 1 with a diameter of 1.128, using two wires each having an area of 0.5 results in each wire having a diameter of 0.798. Since wires 11 are placed side by side this permits reducing the overall screen height equal to 1.128 minus 0.798 or 0.330 which produces a smaller depth for screen 10 than the larger single wire would. When double wires are required currently only one set of either wires 12 or 14 have been doubled. If required however, double wires could be provided both for wires 12 and 14. There are no requirements foreseen where more than two wires will be required, however the same principle of dividing the required wire strength between a greater number of wires than two could be applied if such a requirement arises.

Screen 10 is produced using the same molding techniques as those were used for existing polyurethane screens. An upwardly open mold supported horizontally has two sets of parallel channels oriented perpendicular to each other to provide channels for webs 12 and 14 and holes 20. The mold is inverted with respect to the view shown in FIGS. 1 and 2. A structure surrounding the mold provides a number of hooks hold wires 16 and 18 in place generally centered within each channels. Wires 16 and 18 need not placed under tension in this process.

Figure 4:
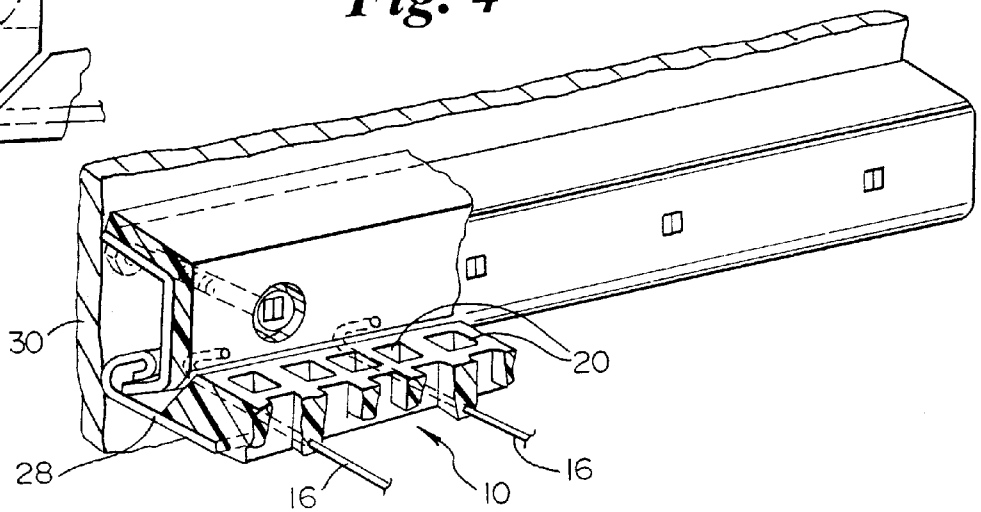
FIG. 4 is an isometric view of a portion of the screen and attachment apparatus.
Figure 3:
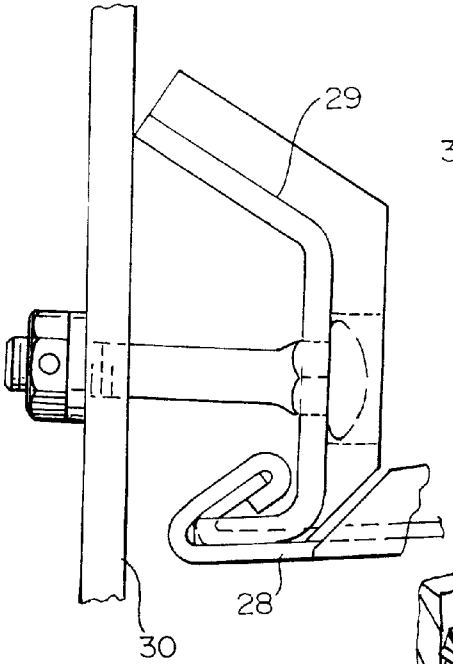
FIG. 3 is a side view of the end of the screen and attachment apparatus.

Polyurethane, which is made from raw materials, is poured into the molds and around the wires and allowed to cure. After curing, the edges 26 of screen 10 are shaped and hook channels 26 attached on two opposite edges of the screen to provide attachment means for the screen. FIGS. 3 and 4 show hook 28 engaging a mating bracket 29 secured to a supporting structure 30 by a bolt extending through a hole in the structure secured by a nut. This arrangement not only provides a secure attachment of screen 10 to a surrounding supporting structure 30 but also permits changing the amount of tension placed across the screen by the amount of tension placed on the bolt by tightening the nut.

Figure 5:
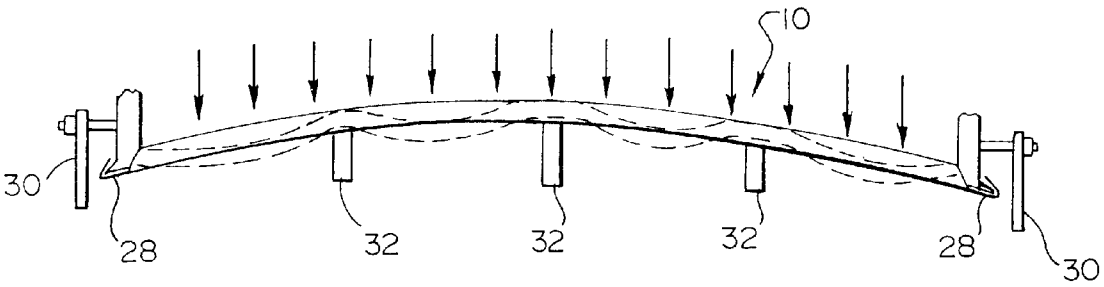
FIG. 5 is a side view of a screen, attached bucker bars and a portion of the attached apparatus.

An additional support for screen 10 is shown in FIG. 5, where bucker bars 32 are attached across the bottom of screen 10 perpendicular to hooks 28 extending from edge to edge. Bars 32 are attached to a portion of structure 30 which extends across each end of bars to support the bottom edges of bars 32 horizontally. Since the center bar 32 is wider than the outer bars this will provide a dome like shape for screen 10 which is preferred for efficient screening. If other shapes are required for screen 10 the widths of bars 32 can be changed accordingly.

This improved screen incorporates the tensile strength within the plastic structure which improves both its strength and wearability above existing screens. The increase in hole size from top to bottom greatly minimizes and may even eliminate the problem of particles entering a hole and then blocking it. The hook attachment means for the screen permits establishing as much tension across the screen as desired. Bucker bars permit establishing a desired screen shape without placing tension on the screen.

While this invention has been described with reference to an illustrative embodiment, this description is not intended to be construed in a limiting sense. Various modifications of the illustrative embodiment, as well as other embodiments of the invention, will be apparent to persons skilled in the art upon reference to this description. It is therefore contemplated that the appended claims will cover any such modifications or embodiments as fall within the true scope of the invention.

What is claimed is:

1. An improvement in apparatus for screening aggregate according to size, the improvement comprising:

a) an essentially planar, unitary plastic screen having a first side and a second side with the first side arranged to face aggregate to be screened, said screen being essentially rectangular in shape having opposed first edges and essentially perpendicular opposed second edges, having a plurality of essentially parallel first webs spaced a predetermined distance apart from one another extending between said first edges; and having a plurality of essentially parallel second webs spaced a predetermined distance apart from one another extending between said second edges, said webs having a plurality of intersections and a plurality of web segments extending therebetween, having at least one hole extending through each portion of said sheet located between opposed first web segments and adjacent opposed second web segments, and b) a first set of wires having a plurality of flexible first wires, and a second set of wires having a plurality of flexible second wires, arranged such that at least one first wire is enclosed by and generally centered within each said first web, and at least one second wire is enclosed by and generally centered within each said second web.

2. The improvement as in claim 1 wherein said screen is made of polyurethane.

3. The improvement as in claim 2 further comprising each hole through said screen having a first opening at the first side of said screen, having a larger second opening at the second side of said screen, and having essentially linear connections therebetween.

4. The improvement as in claim 2 wherein each first web encloses more than one wire.

5. The improvement as in claim 2 wherein each first web and each second web enclose more than one wire.

6. The improvement as in claim 2 further comprising said first wires and said second wires being interwoven.

7. The improvement as in claim 2 further comprising said screen having a plurality of spaced bucker bars underlying the second side thereof extending across said screen from edge to edge, said bucker bars having edges opposite edges engageable by said screen which define a common plane, said screen assuming a crowned shape when said bucker bar engageable edges are engaged by said second side of said screen.

8. The improvement as in claim 2 further comprising said sheet having hook channel attachment means mounted on opposite edges of said sheet for securing said sheet.

9. The improvement as in claim 8 further comprising said screen having a plurality of spaced bucker bars underlying the second side thereof extending across said screen from edge to edge generally perpendicular to said channel attachment means, said bucker bars having edges opposite edges engageable by said screen which define a common plane, said screen assuming a crowned shape when said bucker bar engageable edges are engaged by said second side of said screen.

* * * * *